US006855242B1

(12) United States Patent
Comninellis et al.

(10) Patent No.: US 6,855,242 B1
(45) Date of Patent: Feb. 15, 2005

(54) ELECTROCHEMICAL PRODUCTION OF PEROXOPYROSULPHURIC ACID USING DIAMOND COATED ELECTRODES

(75) Inventors: Christos Comninellis, Lausanne (CH); Pierre A. Michaud, Lausanne (CH); Werner Hänni, Neuchatel (CH); Andre Perret, Neuchatel (CH); Matthias Fryda, Itzchoe (DE)

(73) Assignees: Fraunhofer-Gesellschaft Zur Forderung der Angewandten Forschung e.V. (DE); CSME (DE)

( * ) Notice: Subject to any disclaimer, the term of this patent is extended or adjusted under 35 U.S.C. 154(b) by 43 days.

(21) Appl. No.: 10/110,010

(22) PCT Filed: Oct. 4, 2000

(86) PCT No.: PCT/EP00/09712

§ 371 (c)(1),
(2), (4) Date: Sep. 25, 2002

(87) PCT Pub. No.: WO01/25508

PCT Pub. Date: Apr. 12, 2001

(30) Foreign Application Priority Data

Oct. 6, 1999 (DE) ..... 199 48 184

(51) Int. Cl.[7] ..... C25B 1/28
(52) U.S. Cl. ..... 205/471; 205/472; 204/242
(58) Field of Search ..... 205/471, 472; 204/242

(56) References Cited

U.S. PATENT DOCUMENTS 4,802,959 A * 2/1989 Lipsztajn ..... 205/472
6,375,827 B1 * 4/2002 Kurosu et al. ..... 205/687
6,503,386 B2 * 1/2003 Lehmann et al. ..... 205/471

FOREIGN PATENT DOCUMENTS

EP 0 714 997 B1 6/1996
EP 0 730 043 A1 9/1996

OTHER PUBLICATIONS

Martin H. et al., "Hydrogen and Oxygen Evolution on Boron–Doped Diamond Electrodes," Journal of the Electrochemical Society, vol. 143 (No. 6), p. 133–136, (Jun. 1996).

Beck F. et al., "Boron doped diamond/titanium composite electrodes for electrochemical gas generation from aqueous electrolytes," Electrochimica Acta vol. 44 No. 2–3, Elsevier Science Ltd., p. 525–532, XP004137778, (Sep. 15, 1998).

Perret A. et al., "Diamond Electrodes and Microelectrodes," Electrochemical Society Proceedings, vol. 97 to 32, no date.

Katsuki et al., "Electrolysis by using diamond thin film electrodes," Chemical Abstracts, vol. 126, (No. 24), Abstract No. 322348, (Jun. 16, 1997).

Michaud, P.A., et al., "Preparation of Perosodisulfuric Acid Using Boron–Doped Diamond Thin Film Electrodes," Electrochemical and Solid–State Letters, vol. 3, No. 2, The Electrochemical Society, Inc., p. 77–79, XP002158202 (Dec. 15, 1999).

* cited by examiner

*Primary Examiner*—Arun S. Phasge
(74) *Attorney, Agent, or Firm*—Salter & Michaelson

(57) ABSTRACT

A process for the electrochemical production of peroxo-disulfuric acid and peroxo-disulfates is provided. In the process, an anode having a partially pre-polarized electrode which has been provided with a doped diamond layer is used.

30 Claims, 3 Drawing Sheets

ELECTROCHEMICAL PRODUCTION OF PEROXOPYROSULPHURIC ACID USING DIAMOND COATED ELECTRODES

BACKGROUND

1. Technical Field

The present invention relates to the electrochemical production of peroxo-disulfuric acid with the use of diamond-coated electrodes.

2. Related Art

With a normal potential ($E_o$) of 2.01 V, peroxo-disulfuric acid ($H_2S_2O_8$) is one of the strongest known oxidizing agents, which is used in a wide variety of fields. The most important areas of application of peroxo-disulfuric acid include etching processes in the electronics industry and the production of particular plastics, for example use in the polymerization of acrylonitrile.

Peroxo-disulfuric acid also has applications in waste treatment, the oxidation of dyestuffs and the bleaching of fibers. In addition to this, peroxo-disulfuric acid is an important intermediate product for the electrochemical production of hydrogen peroxide.

The mechanism of the formation of peroxo-disulfuric acid by the anodic oxidation of sulfuric acid is complex. It is assumed that it comprises the formation of hydroxyl radicals. According to the mechanism water is first of all discharged at the anode with the formation of adsorbed hydroxyl radicals (see Equation 1). The hydroxyl radicals, which are present adsorbed at the diamond surface, react with the hydrogen sulfate ions (see Equation 2) contained in the electrolyte, which form the actual peroxo-disulfuric acid in a subsequent dimerization step (see Equation 3).

$$H_2O \rightarrow OH. + H^+ + e^- \quad (1)$$

$$H\Sigma O_4^- \rightarrow HSO_4. + e^- \quad (2)$$

$$(2\ HSO_4. \rightarrow H_2S_2O_8). \quad (3).$$

High concentrations of sulfuric acid and high current densities are required in this case, because when dilute solutions and small current densities are present, the low concentration of discharged sulfate ions results in the latter not reacting with one another (see Equation 3), but with the water, with the formation of oxygen:

$$SO_4 + H_2O \rightarrow H_2SO_4 + \tfrac{1}{2}O_2 \quad (4)$$

There may furthermore be formed as by-products: oxygen by the decomposition of water, ozone, peroxo-monosulfuric acid and hydrogen peroxide, according to the following (see Equations 5 and 6:

$$H_2S_2O_8 + H_2O \rightarrow H_2SO_5 + H_2SO_4 \quad (5)$$

$$H_2SO_5 + H_2O \rightarrow H_2SO_4 + H_2O_2 \quad (6).$$

The effectiveness of the electrochemical peroxo-disulfuric acid production depends substantially on the electrode material used, of which high requirements are made because of the prevailing oxidative and corrosive conditions.

For example, the electrode material must be corrosion-resistant and stable against anodic dissolution.

Furthermore, the peroxo-disulfuric acid formation takes place in a potential range in which water is already decomposed with the production of oxygen. In order to suppress the competing oxygen production, therefore, the electrode material must exhibit a high overvoltage for the reaction.

Flat, large-area platinum electrodes are currently used for the large-scale electrochemical production of peroxo-disulfuric acid, with high sulfuric acid concentrations and high current densities. However, the platinum electrodes are gradually dissolved in the course of the reaction, so that the corrosion products obtained have to be removed by complicated cyclical means.

In order to obtain a satisfactory yield, a highly-concentrated sulfuric acid solution containing 7.5 moles must furthermore be used as electrolyte. Highly-concentrated sulfuric acid solutions of this kind may now, however, because of the oxidative and corrosive properties, be handled in special units and are therefore expensive in equipment terms.

Because of the expensive equipment required, peroxo-disulfuric acid is produced in plants specially equipped for it and has to be procured from there. It would be desirable, however, for peroxo-disulfuric acid to be able to be produced as required directly on site, that is to say at the place of use, since peroxo-disulfuric acid is because of its extremely reactive properties difficult to store and in addition free peroxo-disulfuric acid is subject to rapid hydrolysis in aqueous solution.

Just recently, diamond-coated electrodes have because of their high chemical stability been attracting increasing interest for applications in electrochemical processes.

Such electrodes, in which a boron- or nitrogen-doped diamond layer is applied to a suitable support material, may be obtained in the main by means of the known CVD (Chemical Vapor Deposition) technique.

For example, EP 0 714 997 B1 discloses the use of an electrode of a metal-containing substrate, in particular titanium, to which a boron-doped diamond layer has been applied, for the oxidation of spent photographic baths and in the electronics or optoelectronics sectors.

It has been found, however, that the adhesive strength of diamond layers on metal-containing support materials such as titanium is not satisfactory.

To improve the adhesiveness, therefore, in EP 0 730 043 A1 an intermediate layer is provided between the support material and the diamond layer, which consists of the decomposition products of a metallocene, preferably biscyclo-pentadienyltitanium chloride.

The production of diamond-coated electrodes with silicon as support material for small areas of not more than 1 $cm^2$ is described for example by G. M. Swain in: Adv. Mater. 6 (1994), p.388.

In a number of papers, moreover, a very great potential range is reported for diamond electrodes, in which no water decomposition and hence oxygen production occurs (H. B. Martin, A. Argoitia, U. Landau, A. B. Anderson, J. C. Angus: J. Electrochem. Soc. 143 (1996) L 133; F. Beck, H. Krohn, W. Kaiser, M. Fryda, C. P. Klages, L. Schäfer: Electrochimica Acta 44 (1998) 525).

However, there occurs also there, in the potential ranges favorable for the electrochemical production of peroxo-disulfuric acid, a significant evolution of oxygen, so that a suitability in principle of the electrodes for a peroxo-sulfuric acid production in large, economically significant yields-specifically also with low sulfuric acid concentrations-was not able to be assumed.

It is also reported that ozone may be obtained with diamond electrodes having silicon as support, (A. Perret, W. Haenni, P. Niedermann, N. Skinner, Ch. Comninellis, D. Gandani: Electrochemical Society Proceedings, Volume 97–32 (1997) 275).

The diamond-coated electrodes described above exhibit in general the disadvantage that either the diamond layer may be deposited only on small surfaces (G. M. Swain op. cit.) or, as disclosed in EP 0 730 043 A1, electrochemically stable electrodes with sufficiently firmly adhering diamond layers may be obtained only with the use of a specially applied intermediate layer.

The object of the present invention is to provide a process for the electrochemical production of peroxo-disulfuric acid and peroxo-disulfates, with which peroxo-disulfuric acid or the peroxo-disulfate may be obtained in economically significant yields on a large scale, including with low sulfuric acid concentrations.

The object according to the invention is achieved by a process in which peroxo-disulfuric acid and peroxo-disulfates are produced electrochemically with the use of electrodes coated with doped diamond.

Surprisingly, it was found according to the invention that contrary to expectations electrodes coated with doped diamond are extremely well suited to the electrochemical production of peroxo-disulfuric acid or peroxo-disulfates.

Below the term "peroxo-disulfuric acid" will be used collectively for the compounds peroxo-disulfuric acid and peroxo-disulfates produced.

In particular, if such electrodes are used, sufficiently high yields of peroxo-disulfuric acid may still be obtained even with low sulfuric acid concentrations. The finding is completely contrary to the prevailing view, according to which a high sulfate ion concentration is essential for obtaining high yields and avoiding subsidiary reactions.

Below the electrodes coated with doped diamond will also be referred to by the shortened form "doped diamond electrodes".

BRIEF DESCRIPTION OF THE DRAWINGS

The invention will be explained in detail below with reference to the figures, where.

DETAILED DESCRIPTION OF THE PREFERRED EMBODIMENTS

If doped diamond electrodes are used, satisfactory yields are obtained even with sulfuric acid concentrations as low as only 0.1 mole.

For the process according to the invention, the concentration of the sulfuric acid solution is preferably set in a range of 0.1 mole to 7.5 mole, in particular 1 mole. If the concentration is less than 0.1 mole, the yields become uneconomic. Although the doped diamond electrodes used according to the invention are because of their high stability and electrochemical properties suitable in principle for use in highly concentrated sulfuric acid solutions, a sulfuric acid solution containing more than 7.5 mole may nevertheless be handled industrially only with difficulty.

A current density suitable for the process according to the invention lies in a range of 10 mA/cm$^2$ to 5000 mA/cm$^2$, in particular 100 mA/cm$^2$ to 1000 mA/cm$^2$, preferably 100 mA/cm$^2$ to 400 mA/cm$^2$.

Figure 2:
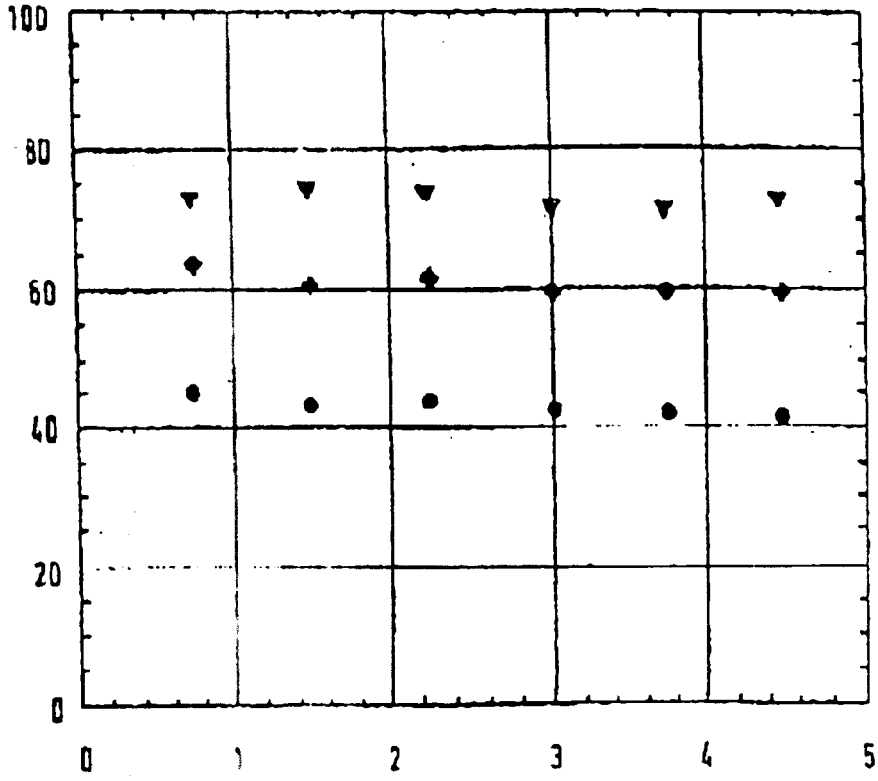
FIG. 2 a diagram in which the dependence of the effectiveness of the doped diamond electrodes used according to the invention on the sulfuric acid concentration and the current density is represented.

In general it may be stated that the effectiveness rises with increasing concentration of the sulfuric acid solution and increasing current density. The dependence of the effectiveness on the sulfuric acid solution concentration and the current density is shown in FIG. 2. In FIG. 2 the loading in Ah/dm$^3$ is plotted on the right and the amount of the theoretically possible conversion rate in % at the top. Six measured values are entered for each of three series of measurements. Circles represent measurements with 0.1 m $H_2SO_4$ at 30 mA/cm$^2$, squares represent measurements with 7.5 m $H_2SO_4$ at 30 mA/cm$^2$ and triangles represent measurements with 7.5 m $H_2SO_4$ at 200 mA/cm$^2$.

Thus there is achieved with the process according to the invention with the use of doped diamond electrodes having an $H_2SO_4$ concentration of 1 mole and a current density of only 30 mA/cm$^2$ an effectiveness of 47%, which may be increased to up to 75% if the concentration is increased to 7.5 mole and the current density to 200 mA/cm$^2$.

The diamond electrodes used for the process according to the invention may be of any form. Plate, expanded metal, lattice or mesh electrodes may be used. A so-called expanded metal form is particularly suitable for large-scale plants. Advantageous properties are thereby utilized, such as good electrolyte exchange, economical use of expensive base metals and a largely homogeneous current output due to homogeneously distributed preferred areas for the anode reaction such as tips and edges. In addition, the form may be coated particularly reliably. The electrode form is particularly suitable also for electrolyte solutions with low $H_2SO_4$ concentration.

Sintered plate electrodes, which may be porous or dense, may be used as plate electrodes.

According to a particular embodiment it is also possible to use so-called three-dimensional electrodes such as ball electrodes. Ball electrodes may be formed of a multiplicity of coated ball-shaped electrodes, which are swept by the electrolyte in the manner of a fluidized bed.

The cell type is also not subject to any particular limitations. Monopolar or bipolar cells with or without separation or subdivision of the electrode chambers by, for example, ion-selective membranes may be used.

A separation of the electrode chambers by, for example, ion-selective membranes is however to be recommended in order to prevent a cathodic reaction of the peroxo-disulfuric acid formed. The yields may be improved still further by such a measure.

Particularly suitable for the process according to the invention are doped diamond electrodes such as are described in the subsequent printed publications DE 198 42 396 A1 and EP 0 994 074 A2 of the applicant, to which reference is explicitly made here.

Using the measures described there for the known gas-phase deposition process (CVD), sufficiently large support materials and ones with complex shapes (hereinafter called "base bodies") may be coated with continuous, easily adhering diamond layers.

Thus the homogeneous coating of sufficiently large areas up to a few thousand cm$^2$ in size is possible with the process.

It has been found that with the process described there electrically conductive diamond layers with a specific resistance of an order of magnitude of between 0.005 and 10

Ωcm may be deposited directly on a metallic, graphite or ceramic base material in an electrochemically stable manner.

Examples of suitable metallic base materials are niobium, tantalum, titanium and zirconium, wherein tantalum is particularly preferred. Examples of suitable ceramic base materials are silicon, silicon carbides such as silicon-filtered SiSiC or SiC, and silicon nitride, which exhibit a sufficient conductivity.

Preferably use is made for the base material of a self-passivating material, in particular a self-passivating metal, whereby impairment or damage of the electrode or the base material due to electrolyte solution which could penetrate into the electrode interior through pores or cracks possibly appearing in the deposited layer during the gas-phase deposition is prevented. Examples of such self-passivating metals are the aforementioned elements titanium, niobium, tantalum or zirconium, as well as alloys of the materials or else other self-passivating metals. Titanium, however, is the first choice on cost grounds.

According to the invention the diamond layer may preferably be doped with boron, nitrogen, phosphorus or sulfur, wherein boron and nitrogen are particularly preferred. The content of boron may lie between 0.05 ppm or 10 ppm and 10,000 ppm, preferably between 0.05 ppm and 100 ppm. The content of nitrogen may lie between 5 ppm and 100 ppm.

The diamond electrodes described in the above-mentioned subsequent printed publications DE 198 42 396 A1 and EP 0 994 074 A2 are characterized by a particularly high adhesion of the diamond layer to the base material. It is assumed that the exceptional adhesion is caused by the process-controlled formation of a metal carbide layer at the so-called interface, the transition area between the base material and the layer of diamond, whereby a significantly improved mechanical stability is obtained.

According to the invention it was furthermore established that an improvement in adhesion may also be improved by a carbonitride layer at the interface, wherein particularly good results are observed in this case with ceramic base materials.

Figure 1:
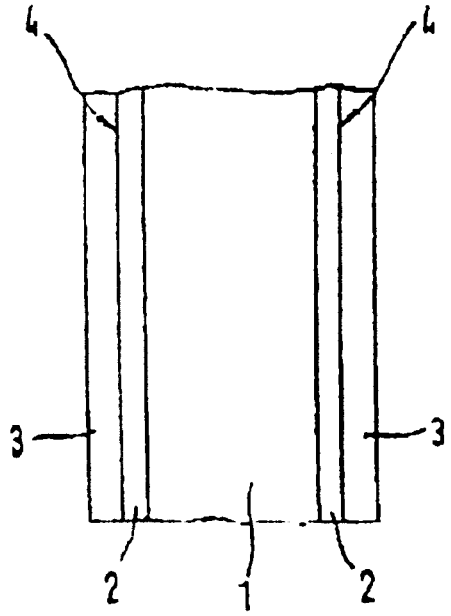
FIG. 1 shows diagrammatically the layout of a preferred embodiment according to the invention of a doped diamond electrode.

In a particularly preferred embodiment, such as that shown in FIG. 1, the electrode may be formed as a composite material electrode, wherein the center 1 of the electrode is formed e.g. of a copper or aluminum core which is characterized by a particularly high conductivity and relatively low costs. The center 1 is covered with a dense envelope 2 of a preferably self-passivating metal, in particular titanium. The electrically conductive doped diamond layer 3 may then be deposited on the envelope 2.

The center 1 and the envelope 2 together form the base material 1, 2, on which the electrically conductive diamond layer 3 is deposited.

Between the diamond layer 2 and the surface area of the envelope 2, the interface area, is located a carburized metal layer 4 which in the aforementioned example consists of titanium carbide.

Below will be described in principle a gas-phase deposition process, taking as an example the so-called Hot Filament CVD technique, for producing the preferably used electrodes.

Use will generally be made, for the gas-phase deposition of a diamond layer on the base material, of a gas mixture which contains a carbon source, hydrogen and a source for the doping means, which according to the example described here is a boron source.

A preferred carbon source is methane and a preferred boron source tri-methylborate, wherein the compounds are preferably used in the ratio of 1:1. Trimethyl borane may also be used in an amount of 0.05 ppm to 100 ppm.

The boron content of the diamond layer may be adjusted by means of the boron content in the gas phase.

For the present invention the figures for the quantitative proportion of the individual components in the gas phase refer to the volume.

In the preferred embodiment the gas phase consists of 95% to 99.9% hydrogen ($H_2$); 0.1% to 5% methane ($CH_4$); and trimethylborate with a content of about 1 ppm to 1%, wherein the trimethylborate: methane ratio does not exceed 1:1. In the preferred embodiment, the hydrogen concentration preferably ranges from 95% to 99% and the methane concentration ranges preferably from 0.5% to 1%.

A smaller or higher proportion of carbon source may be selected depending on the nature of the carbon source used. For methane a proportion of about of 0.5% to 2% in the gas phase has proved to be particularly advantageous. If the proportion is smaller, the growth rate becomes uneconomic, and if the proportion is too high, the quality of the layer obtained suffers.

It should be borne in mind that the trimethylborate or trimethylborane used as boron source represents simultaneously a further carbon source.

The process pressure is set at 5 to 50 hPa, but may also come to up to 300 hPa if required.

The temperature of the heating or glow wires used (also termed "filaments") comes as a rule to 2000° C. to 2400° C., where it may in particular for electrodes with ceramic base material also be up to 2800° C. A high activation of the gas phase for the coating process is thereby obtained. Care is however taken on the substrate side that, depending on the material, temperatures of 600° C. to 950° C. are not exceeded.

The setting of the substrate temperature may also be carried out by adapting the filament diameters, the filaments spacings and/or the filament-substrate distance. External heating or cooling may also be used.

The content of boron in the diamond layer comes preferably to between 10 ppm and 10 000 ppm, it may therefore come to up to 1%, wherein the boron content in the diamond layer as a rule lies far below 1%.

Doped diamond layers with a thickness of between 0.5 $\mu$m and 50 $\mu$m may be obtained with the process described. If the base material is not ceramic, somewhat thicker layers are preferred, for example with a thickness of preferably 2 $\mu$m to 50 $\mu$m, wherein however smaller thicknesses are also possible.

The carburizing at the boundary layer (interface) between base material 1, 2 and diamond layer 3 deposited thereon may for example be carried out in advance prior to the actual deposition of the diamond layer or alternatively be incorporated in the gas-phase deposition process.

In the first alternative the surface carburizing of the base material metals takes place by their being heated to the process temperature in discrete steps in the presence of hydrocarbon and hydrogen.

If the base material metals are coated without prior separate carburizing according to the second alternative, the presence of methane and optionally trimethylborate in the gas phase results in metal carbide also being obtained in the interface area by virtue of chemical reactions, until, as a consequence of the simultaneously occurring deposition of diamond and the thereby occasioned insulation of the existing metal surface from the methane and the trimethylborate, the metal carbide formation is completed.

A mixed form consisting of both alternatives is also possible for the carburizing. However, the separate carburizing is particularly preferred, since it permits a more targeted control of the process.

If a nitride layer is to be formed as intermediate layer, first and foremost a nitrogen source, preferably nitrogen as such, is added as reactive gas, which reacts with the base material surface, in this case preferably a ceramic base material, with the formation of nitrides.

For the gas-phase deposition the base material, consisting of the center 1 with the copper or aluminum core and the envelope 2 consisting of the preferably passivating metal, is roughened at the surface, for example by sand or ball blasting. The roughening serves to support the adhesion. Thereafter a pre-seeding in a suspension of nanodiamond and 0.5 $\mu$m diamond powder in ethanol takes place.

According to a particularly preferred embodiment, doped diamond electrodes are used which have not been subjected to a complete oxidative pre-treatment prior to initial start-up.

For the purpose of the invention the term "complete oxidation" means that the surface of the electrode, which is hydrogenated in the untreated state, is oxidized up to the highest possible oxidation state, it being assumed that carbonyl groups are thereby formed.

Diamond electrodes which have been subjected to such an anodic pre-treatment or polarization are generally considered to be particularly stable and are said to behave unchanged electrochemically over a very long period. Theoretical discussions of this are found in H. B. Martin, A. Arguitia, U. Landau, A. B. Anderson, J. C. Angus, in: J. Electrochem. S.o.k. 143 (1996) L. 133.

Experimental tests have shown, however, that although the desired stabilized state of the electrodes may be achieved by pre-polarization, this is nevertheless at the cost of the intensity and the effectiveness.

Surprisingly, it was found that even non-pre-polarized diamond electrodes, or ones only partially pre-polarized, exhibit a sufficient stability for the production of peroxodisulfuric acid.

If non-pre-polarized diamond electrodes or partially pre-polarized ones are used, the voltage must be held in a range in which complete pre-polarization does not take place. The process is therefore always operated in the potential range below that voltage at which oxygen may evolve, i.e. polarization occurs. In order nevertheless to obtain the highest possible levels of effectiveness, the voltage should however be kept as close as possible below the potential range.

A closer investigation of the effect showed that the effectiveness of the electrode may be increased if prior to actual start-up it is charged deliberately with a load of approximately 0.1 C/cm$^2$ electrode surface for partial oxidation.

"Partial oxidation" means for the purpose of the invention that the oxidation is stopped at a lower oxidation state than that which is set for complete pre-polarization. It is assumed that in so doing hydroxyl groups form at the electrode surface.

The effectiveness increases up to approximately the load, until with further loading it again decreases significantly and finally drops below the original value as previously described.

Figure 3:
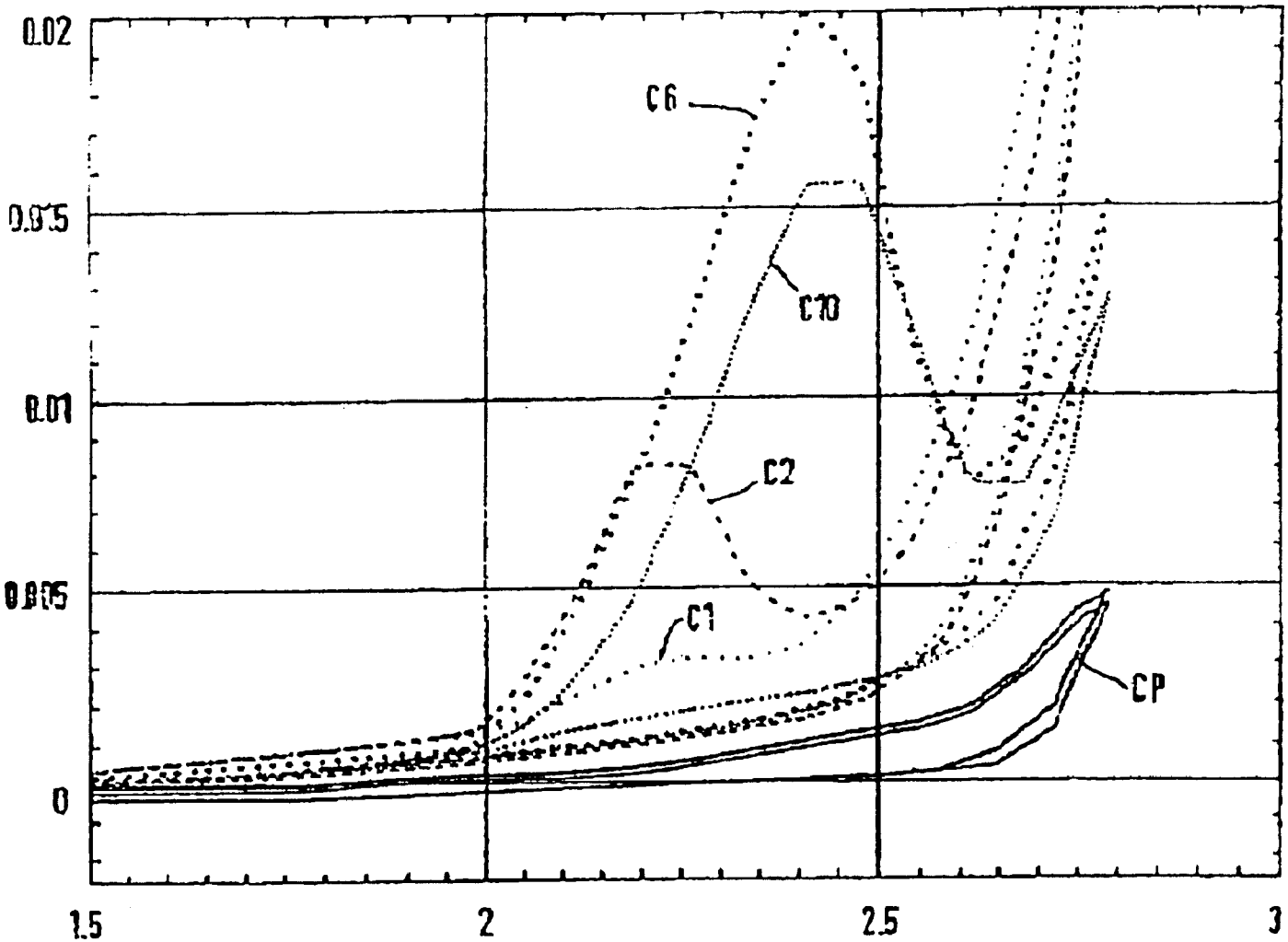
FIG. 3 a cyclogram of a preferably used electrode according to the invention, which has not been subjected to a complete oxidative pre-treatment.

In FIG. 3 the unexpected behavior of diamond electrodes is represented by means of a cyclogram. On the right the potential is plotted in volts versus a standard hydrogen electrode (SHE), at the top the current density in A/cm$^2$. The temperature prevailing at the start of the cyclogram came to 25° C., the counter-electrode consisted of platinum and 1N $H_2SO_4$ was used as electrolyte. The measuring speed came to 200 mV/s.

The cyclogram shows in the solid line the behavior of a diamond electrode after it has been pre-polarized. An oxidative pre-treatment has occurred here, therefore, for example by the application of a very high voltage over a prolonged period.

The other dashed lines of various kinds show the behavior of the diamond electrode preferably used according to the invention without or with a partial pre-polarization. Already during the first cycle a small maximum appears in the range around about 2.2 V, or a turning point at about 2.35 V.

The maximum points to an electrochemical reaction. Only at a still higher voltage does the expected maximum in current density appear due to the increasing evolution of oxygen.

If the same electrode is now subjected to a further cycle, the maximum soon becomes very clear at about 2.2 V and the subsequent minimum at 2.2 V is clearly discernible. The trend continues with further cycles. It becomes strongest in the 6th cycle, in which the maximum has here shifted to about 2.4 V and the subsequent minimum now also occurs at a higher voltage value of about 2.65 V.

In still further cycles the value of the maximum then again decreases significantly. The curve for the 10th cycle is still represented. The maximum shifts further to higher voltage values, but declines in its level. The subsequent minimum also shifts to higher voltage values. The trend continues in further cycles not shown here in the figure.

The non-reversible, electrochemical reaction therefore initially increases in intensity with each cycle, and then decreases again. In the last analysis the solid black line is at the same a trend-like development which is also aimed for as a maximum value in further cycles.

It is clearly discemible in turn that the electrochemical reaction continues to occur only with low intensity after the pre-polarization. The formation of highly reactive oxygen compounds is involved in the reaction.

The reaction also takes place on other electrode materials, but only with the simultaneous formation of oxygen and hence with far lower efficiency.

In practice the potential will not be applied to the electrodes in the form of one or more cycles, as this is very expensive.

It is nevertheless possible by means of the cycles to determine very precisely for a particular electrode type the applied load at which it operates most effectively, that is to say the load from which the effectiveness decreases again.

Considered in detail, the load per unit of area of the electrode surface is involved here. The optimum load amount per unit of area varies, however, with different electrode types. This is because the surface structure, i.e. the crystal orientation or else the form of the electrode, for example, influences the maximum range.

If however the load content is determined experimentally for a particular electrode type by subjection to a plurality of cycles, the load may be applied specifically for further electrodes of the same type, i.e. not in a plurality of cycles, but by corresponding charging over time to each individual electrode of precisely the load.

It has been found experimentally that the optimum range lies at approximately 0.01 to 1, in particular at approximately 0.1, Coulomb per square centimeter (C/cm$^2$).

The background to this unexpected effect, which has not been reported to date in publications, probably lies in the fact that the load application promotes the formation on the crystal surface of OH groups, which then increase the effectiveness of the electrode. If a greater load than for maximum effectiveness is applied, the OH groups possibly start to react with one another and thereby reduce the effectiveness again after reaching the maximum.

It becomes clear from this investigation that the production of reactive oxygen components such as peroxo-disulfuric acid on such diamond electrodes may be influenced advantageously by dispensing with the conventional, that is to say complete pre-polarization. The present process will be illustrated below by means of an example.

EXAMPLE 1

Production of an Electrode with a Boron-doped Diamond Layer

A boron-doped diamond layer was produced by means of HF-CVD (Hot Filament Chemical Vapor Deposition) technique on monocrystalline p-Si (100) wafers (0.1 Ωcm, sold under the name Siltronix).

The temperature of the filaments lay in a range of 2440° C. to 2560° C., and the substrate was held at 830° C. Methane was used as a reactive gas in an excess of hydrogen (1% methane in $H_2$). Trimethylborane in a concentration of 3 ppm was used for the doping. The gas mixture was added to the reaction chamber at a flow rate of 5 $dm^3$/min, wherein a growth rate of 0.24 μm/h was obtained for the diamond layer. The diamond layer obtained had a thickness of about 1 μm. Columnar, randomly textured polycrystalline layers were obtained.

EXAMPLE 2

Production of Peroxo-disulfuric Acid

Figure 4:
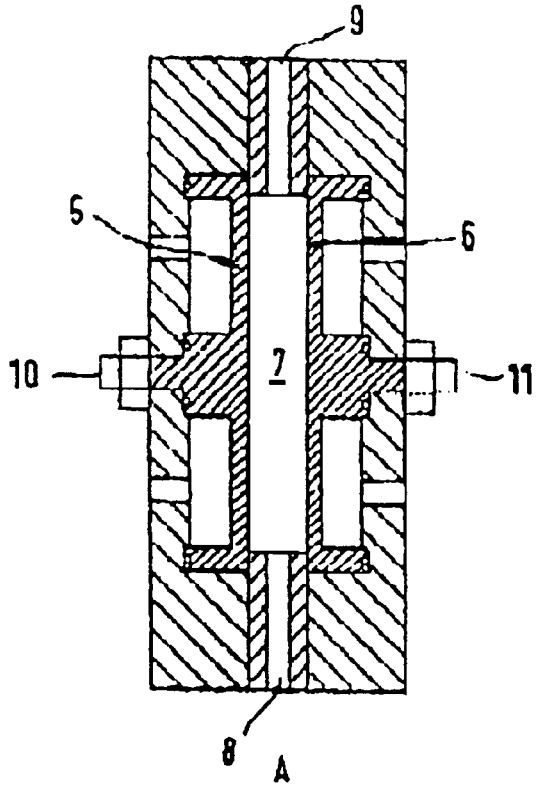
FIG. 4 diagrammatically the electrolytic cell used according to the example.

Peroxo-disulfuric acid was produced using electrodes obtained according to Example 1. The production took place in a single-cell electrolytic flow cell A (FIG. 4) with $H_2SO_4$ as electrolyte 7 with an electrolyte inlet 8 and an electrolyte outlet 9 together with electric connections 10, 11. The diamond electrode was the anode 5 and zirconium the cathode 6. Both electrodes were circular with a diameter of 80 mm and an area of 50 $cm^2$ respectively. The distance between the electrodes came to 10 mm. A thermoregulated glass storage container with a capacity of 500 $cm^3$ was used for the electrolyte 7 and circulated through the cell A by means of a pump.

Figure 5:
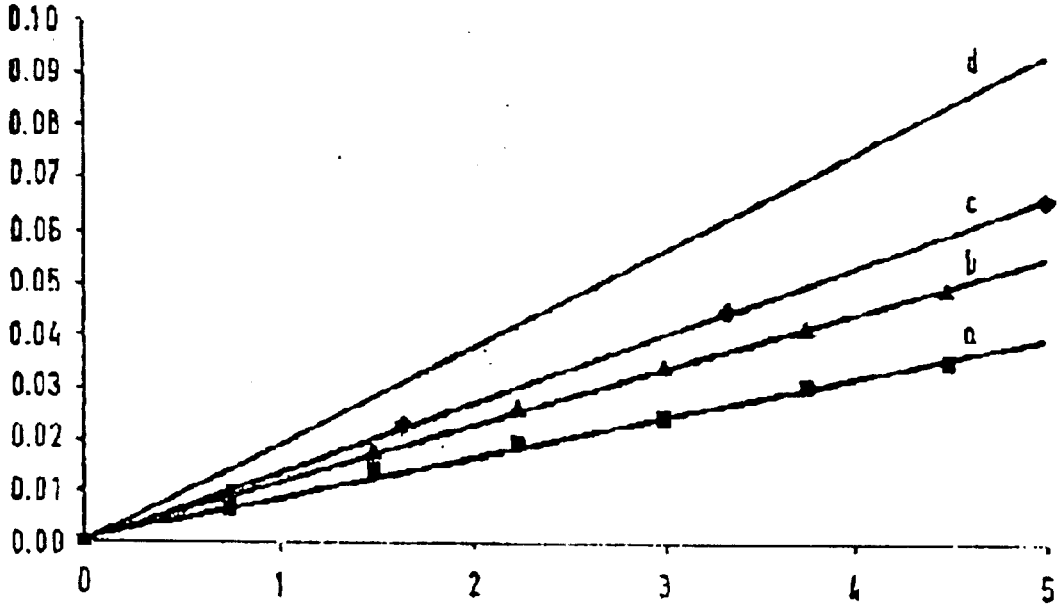
FIG. 5 a further diagram with the $H_2S_2O_8$ concentration as a function of the current density.

The electrolysis was carried out under galvanostatic conditions and an electrolyte temperature of 25° C. During the electrolysis the concentration of the peroxo-disulfuric acid was determined by means of iodometric titration and plotted as a function of the specific electric charge (Ah/$dm^3$) used (FIG. 5). The formation of peroxo-disulfuric acid was confirmed by means of the specific $Ni(OH)_2$ test in the presence of silver nitrate in order to avoid disturbing reactions with other oxidizing agents such as $H_2O_2$.

In order to prevent the electrochemical reduction of peroxo-disulfuric acid at the cathode and its hydrolysis to peroxo-monosulfuric acid, the electrolysis took place with a low sulfuric acid conversion rate (<5%) and with short electrolysis times (<1 h).

The result is shown in FIG. 5 in which the load is plotted on the right in Ah/$dm^3$ and the concentration of $H_2S_2O_8$ at the top in mole/l. The four series of measurements entered then represent the following curves:

(*a*) sulfuric acid concentration: 1.0 mole/L, current density i=30 mA/cm (*b*) sulfuric acid concentration: 7.5 mole/L, current density i=30 mA/$cm^2$ (*c*) sulfuric acid concentration: 7.5 mole/L, current density i=200 mA/$cm^2$ (*d*) theoretical sulfuric acid concentration with an effectiveness of 100%; temperature respectively 25° C.

The theoretical value according to (d) was calculated for Faraday's law and a normal potential $E_o$=2.01 V for $SO_4^{2-}$/$S_2O_8^{2-}$.

What is claimed is:

1. A process for the electrochemical production of peroxo-disulphuric acid and peroxo-disulphates by the electrochemical oxidation of sulfuric acid, comprising the step of:

using an electrode coated with a doped diamond layer.

2. The process of claim 1, wherein the sulfuric acid concentration of the electrolyte ranges from 0.1 mole to 7.5 mole.

3. The process of claim 1, further comprising the step of:

carrying out the electrolysis using a current density ranging from 10 mA/$cm^2$ to 5000 mA/$cm^2$.

4. The process of claim 1, further comprising the step of:

using a monopolar cell as the electrolytic cell.

5. The process of claim 4, further comprising the step of:

subdividing the electrode chamber of the cell.

6. The process of claim 5, wherein the electrode chamber of the cell is subdivided by an ion-selective membrane.

7. The process of claim 1, further comprising the step of:

selecting the electrode form from the group consisting of a plate electrode, an expanded metal electrode, a lattice electrode, a mesh electrode and a three-dimensional electrode.

8. The process of claim 7, further comprising the step of:

selecting a sintered plate electrode.

9. The process of claim 8, wherein the plate electrode is a porous sintered plate or a dense sintered plate.

10. The process of claim 1, wherein the anode comprises a large-area layer of doped diamond consisting of a base material.

11. The process of claim 10, further comprising:

an intermediate layer positioned between the base material and the layer of diamond.

12. The process of claim 11, wherein the intermediate layer is a carburized intermediate layer.

13. The process of claim 12, wherein the carburized intermediate layer is a metal carbide layer or a carbonitride layer.

14. The process of claim 11, wherein the intermediate layer is formed from a material that is selected from the group consisting of titanium, niobium, tantalum, zirconium, and alloys thereof, silicon, silicon carbide, silicon-filtered silicon carbide (SiSiC), and silicon-based ceramic.

15. The process of claim 10, further comprising the step of:

doping the layer of diamond with an element selected from the group consisting of boron, nitrogen, phosphorus, and sulfur.

16. The process of claim 15, further comprising the step of:

doping the layer of diamond with boron.

17. The process of claim 16, wherein the boron content in the layer of diamond ranges from 10 ppm to 10,000 ppm.

18. The process of claim 15, wherein the nitrogen content in the layer of diamond ranges from 5 to 100 ppm.

19. The process of claim 1, wherein the doped diamond layer is partially polarized.

20. The process of claim 19, further comprising the step of:

charging the electrode surface with a load of 0.01 $C/cm^2$ to 1 $C/cm^2$ before the step of electrolysis.

21. The process of claim 19, further comprising:

performing the electrolysis below the potential range at which a substantial oxygen evolution occurs at the electrode.

22. The process of claim 21, wherein the voltage at the electrode lies during operation precisely in the potential range at which an oxygen evolution starts.

23. The process of claim 19, further comprising the step of:

charging the electrode surface with a load of 0.05 $C/cm^2$ to 0.2 $C/cm^2$ before the step of electrolysis.

24. The process of claim 1, further comprising the step of carrying out the electrolysis using a current density ranging from 100 $mA/cm^2$ to 1000 $mA/cm^2$.

25. The process of claim 1, further comprising the step of:

using a bipolar cell as the electrolytic cell.

26. The process of claim 25, further comprising the step of:

subdividing the electrode chamber of the cell.

27. The process of claim 26, wherein the electrode chamber of the cell is subdivided by an ion-selective membrane.

28. A method of using an electrode for the electrochemical production of peroxo-disulfuric acid and peroxo-disulfates, the method comprising:

using an electrode coated with a doped diamond layer.

29. A cell for producing peroxo-disulfuric acid and peroxo-disulfates, the cell comprising:

a housing;

an electrode coated with a doped diamond layer, the electrode having a substantially hydrogenated surface;

a counter-electrode having a substantially hydrogenated surface; and a sulfuric acid electrolyte;

wherein the electrode and counter-electrode are arranged in the housing.

30. The cell of claim 29, wherein the electrode chamber is subdivided.

* * * * *

US006855242C1

(12) EX PARTE REEXAMINATION CERTIFICATE (7299th)

United States Patent

Comninellis et al.

(10) Number: US 6,855,242 C1

(45) Certificate Issued: Jan. 5, 2010

(54) ELECTROCHEMICAL PRODUCTION OF PEROXOPYROSULPHURIC ACID USING DIAMOND COATED ELECTRODES

(75) Inventors: Christos Comninellis, Lausanne (CH); Pierre A. Michaud, Lausanne (CH); Werner Hänni, Neuchatel (CH); Andre Perret, Neuchatel (CH); Matthias Fryda, Itzchoe (DE)

(73) Assignee: Adamant Technologies SA, La Chaux-de-Fonds (CH)

Reexamination Request:
No. 90/008,661, Jul. 2, 2007

Reexamination Certificate for:

| | |
|---|---|
| Patent No.: | **6,855,242** |
| Issued: | **Feb. 15, 2005** |
| Appl. No.: | **10/110,010** |
| Filed: | **Sep. 25, 2002** |

(22) PCT Filed: Oct. 4, 2000

(86) PCT No.: PCT/EP00/09712

§ 371 (c)(1), (2), (4) Date: Sep. 25, 2002

(87) PCT Pub. No.: WO01/25508

PCT Pub. Date: Apr. 12, 2001

(30) Foreign Application Priority Data

Oct. 6, 1999 (DE) ..... 199 48 184

(51) Int. Cl.
*C25B 1/28* (2006.01)
*C25B 1/00* (2006.01)

(52) U.S. Cl. ..... 205/471; 204/242; 205/472

(58) Field of Classification Search ..... None
See application file for complete search history.

(56) References Cited

U.S. PATENT DOCUMENTS

| | | | | | |
|---|---|---|---|---|---|
| 3,446,725 | A | * | 5/1969 | Spengler et al. | 204/242 |
| 4,617,163 | A | * | 10/1986 | Smith | 264/235.6 |
| 4,802,959 | A | * | 2/1989 | Lipsztajn | 205/472 |
| 4,851,099 | A | * | 7/1989 | Brereton | 204/256 |
| 5,399,247 | A | * | 3/1995 | Carey et al. | 205/688 |
| 5,523,518 | A | * | 6/1996 | Shikami et al. | 205/770 |

FOREIGN PATENT DOCUMENTS

| | | | |
|---|---|---|---|
| JP | 11-269685 | A * | 10/1999 |
| WO | WO 94/09524 | A1 * | 4/1994 |

OTHER PUBLICATIONS

Balej et al, "Influence of Sulphuric Acid Concentration on Current Yield of Peroxodisulphate," Collection Czechoslov. Chem. Commun., vol. 44, pp. 1510–1520, 1979.*

Mikhailov et al, "Solid State Reaction of Mo on H–Terminated Surface of Diamond Thin Films," Solid State Communications, vol. 93, No. 11, pp. 869–873, 1995.*

Katsuki et al, "Electrolysis by Using Diamond Thim Film Electrodes," Japanese Journal of Applied Physics, vol. 36, Part 2, No. 3A, pp. L260–L263, Mar. 1, 1997.*

* cited by examiner

*Primary Examiner*—Alan Diamond

(57) ABSTRACT

A process for the electrochemical production of peroxodisulfuric acid and peroxo-disulfates is provided. In the process, an anode having a partially pre-polarized electrode which has been provided with a doped diamond layer is used.

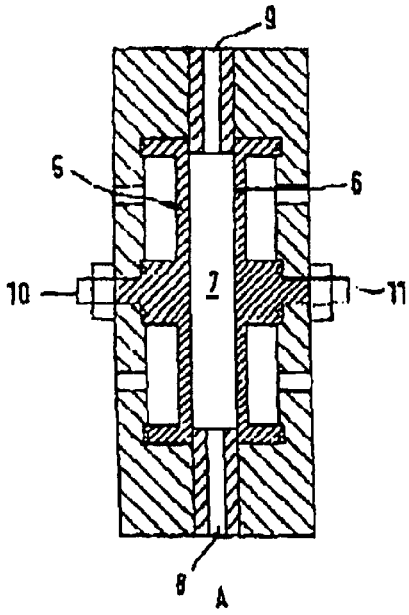

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 28–30 are cancelled.

Claims 1, 3, 7, 19–21, 23 and 24 are determined to be patentable as amended.

Claims 2, 4–6, 8–18, 22 and 25–27, dependent on an amended claim, are determined to be patentable.

1. A process for the electrochemical production of peroxo-disulphuric acid and peroxo-disulphates by the electrochemical oxidation of sulfuric acid, comprising the [step] *steps* of:

using an electrode coated with a doped diamond layer *forming an anode; carrying out the electrochemical oxidation using a current density ranging from 10 mA/cm.sup.2 to 5000 mA/cm.sup.2, and wherein the carrying out step includes performing the electrochemical oxidation below or precisely in the potential range at which an oxygen evolution starts.*

3. The process of claim 1, [further] comprising the step of: carrying out the electrolysis using a current density ranging from [10] *100* mA/cm.sup.2 to [5000] *1000* mA/cm.sup.2.

7. The process of claim 1, further comprising the step of: selecting the electrode [form] from the group consisting of a plate electrode, an expanded metal electrode, a lattice electrode, a mesh electrode and a three-dimensional electrode.

19. The process of claim 1, wherein the doped diamond layer is partially [polarized] *pre-polarized.*

20. [The process of claim 19, further comprising the step of:] *A process for the electrochemical production of peroxo-disulphuric acid and peroxo-disulphates by the electrochemical oxidation of sulfuric acid, comprising the steps of: using an electrode coated with a doped diamond layer; and* charging the electrode surface with a load of 0.01 C/cm.sup.2 to 1 C/cm.sup.2 before the step of electrolysis.

21. [The process of claim 19, further comprising:] *A process for the electrochemical production of peroxo-disulphuric acid and peroxo-disulphates by the electrochemical oxidation of sulfuric acid, comprising the steps of: using an electrode coated with a doped diamond layer; wherein the doped diamond layer is partially polarized and* performing the electrolysis below the potential range at which a substantial oxygen evolution occurs at the electrode.

23. [The process of claim 19, further comprising the step of:] *A process for the electrochemical production of peroxo-disulphuric acid and peroxo-disulphates by the electrochemical oxidation of sulfuric acid, comprising the steps of: using an electrode coated with a doped diamond layer; and* charging the electrode surface with a load of 0.05 C/cm.sup.2 to 0.2 C/cm.sup.2 before the step of electrolysis.

24. The process of claim [1] *20*, further comprising the step of carrying out the electrolysis using a current density ranging from 100 mA/cm$^2$ to 1000 mA/cm$^2$.

* * * * *